US005661988A

United States Patent [19]

Oh et al.

[11] Patent Number: 5,661,988

[45] Date of Patent: Sep. 2, 1997

[54] WASHING STRUCTURE OF A FULLY AUTOMATIC WASHING MACHINE

[75] Inventors: Dong Yeop Oh; Gyu Sang Choe, both of Kyungki-do; Kyung Seop Hong, Inchon-Jikhalsi; Kyung Hwan Kim; Oh Hun Kwon, both of Seoul, all of Rep. of Korea

[73] Assignee: LG Electronics Inc., Seoul, Rep. of Korea

[21] Appl. No.: 579,425

[22] Filed: Dec. 27, 1995

[30] Foreign Application Priority Data

Nov. 7, 1995 [KR] Rep. of Korea ..... 40139/1995

[51] Int. Cl.[6] ..... D06F 13/06

[52] U.S. Cl. ..... 68/131; 68/156

[58] Field of Search ..... 68/53, 131, 132, 68/133, 134, 148, 152, 153, 155, 156

[56] References Cited

U.S. PATENT DOCUMENTS 2,883,844 4/1959 Gil et al. ..... 68/133 X

FOREIGN PATENT DOCUMENTS 13718 3/1988 Japan ..... 68/132

*Primary Examiner*—Philip R. Coe

*Attorney, Agent, or Firm*—Fish & Richardson P.C.

[57] ABSTRACT

A washing net attaching and detaching structure of a fully automatic washing machine with a washing course of dry-marked clothes is shaped as a basket which is attachably and detachably installed within a washtub for being vibrated in the up and down directions in accordance with a reciprocal ascending and descending movement of a driving member to preserve and wash laundry indicated with a dry mark. The washing net has a diameter smaller than an inner circumference of an upper end of the washtub for being easily attached and detached to and from the washtub during the cleaning of dry-marked clothes to provide a convenience to a user and prevent damage to the laundry caused by the laundry being bitten in the lower portion of the washing net, thereby significantly improving the efficiency and reliability of the product.

3 Claims, 4 Drawing Sheets

WASHING STRUCTURE OF A FULLY AUTOMATIC WASHING MACHINE

BACKGROUND OF THE INVENTION

1. Field of the Invention

The present invention relates to a washing net attaching/detaching structure of a fully automatic washing machine with a washing course of dry-marked clothes, and more particularly to a washing net attaching/detaching structure capable of easily attaching/detaching the washing net during the cleaning of clothes indicated with a dry mark in a fully automatic washing machine.

2. Description of the Prior Art

As shown in FIGS. 1 to 3, a conventional fully automatic washing machine incorporated with a washing course for dry-marked clothes is formed such that a motor shaft 4 rotated by the driving of a motor 3 is installed to an upper portion of motor 3 which is mounted to A bottom center of an outer tub 9 FOR producing a power in one direction to attain acceleration and deceleration operations. First and second ratchets 10 and 11 are formed to inner and outer circumferences of an upper portion of motor shaft 4, respectively.

A driving member 5 having an amplitude of 1~100 mm and a rpm of 30~1,800 reciprocates up and down directions together with the rotational movement of motor shaft 4 and is installed on a center of a washing blade 2 coupled with an upper end of motor shaft 4. Third and fourth ratchets 12 and 13 selectively fitted with first and second ratchets 10 and 11 by the driving of motor 3 are formed to an inner center and an outer circumference of driving member 5, respectively. A washing net 6*a* formed of a flexible material is inserted on to driving member 5 within a washtub 1*a* for being vibrated upwardly and downwardly along with the reciprocal ascending and descending movement of driving member 5 to clean and preserve the laundry indicated with a dry mark.

In the washing apparatus according to the present invention constructed as above, motor 3 mounted to the bottom center of outer tub 9 primarily produces power in one direction during the washing of dry-marked clothes. By doing so, motor shaft 4 installed onto motor 3 is rotated to thus rotate driving member 5 which is installed to the center of washing blade 2 joined to the upper end of motor shaft 4 to be operated with an amplitude of 1~100 mm and an rpm of 30~1,800 under the state as shown in FIG. 2B. Here, when first ratchet 10 formed to the inner circumference of the upper portion of motor shaft 4 is fitted with third ratchet 12 formed on the inner center of driving member 5 as shown in FIG. 2A, driving member 5 ascends.

Additionally, first and third ratchets 10 and 12 are separated from each other at a point of completing the ascending of driving member 5. Simultaneously, second ratchet 11 formed to the outer circumference of motor shaft 4 is fitted with fourth ratchet 13 formed to the inner circumference of driving member 5, thereby descending driving member 5.

At a point of completing the descending of driving member 5, second and fourth ratchets 11 and 13 are separated from each other, and at the same time, the above-described process is repeated. Therefore, driving member 5 reciprocally ascends or descends together with the rotation of washing blade 2 in one direction, so that washing net 6*a* inserted to driving member 5 while housing the laundry thereon is vibrated in the up and down directions along with the reciprocal ascending and descending movement of driving member 5. Consequently, the dry-marked laundry is beaten without being damaged to preserve and efficiently clean the dry-marked clothes.

On the other hand, when the conventional fully automatic washing machine with a washing course for dry-marked clothes employs a flat washing net 6*a* which is capable of being folded during execution of a the washing operation as shown in FIG. 3 to have a diameter $D_1$ larger than a diameter $D_2$ of the inner circumference of the upper end of washtub 1*a*, washing net 6*a* is folded to be put into washtub 1*a* installed with a fluid balancer 14 from the inner circumference at the upper end of washtub 1*a*. Then, washing net 6*a* is inserted to driving member 5 to be used under the state that washing net 6*a* is exploded within washtub 1*a*.

However, since conventional washing net 6*a* is linked with driving member 5 to reciprocally ascend and descend altogether, the end of washing net 6*a* cannot be closely attached to the inside of washtub 1*a* to have a slight split. Due to this, the laundry is frequently bitten therein and damaged during the reciprocal ascending and descending movement for cleaning.

SUMMARY OF THE INVENTION

The present invention is devised to solve the above-described problems. Accordingly, it is an object of the present invention to provide a washing net attaching/detaching structure for a fully automatic washing machine incorporating a washing course for dry-marked clothes for easily attaching/detaching a washing net and with a simple structure to allow a user to easily manipulate the washing machine and prevent a damage upon the laundry caused by being thrown in a lower portion of the washing net.

To achieve the above object of the present invention, there is provided a washing net attaching/detaching structure for a fully automatic washing machine with a washing course of dry-marked clothes including a basket-type washing net which is attachably/detachably installed within a washtub for being vibrated in the up and down directions in accordance with a reciprocal ascending and descending movement of a driving member to preserve and wash the laundry indicated with a dry mark.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

A washing net attaching/detaching structure of a fully automatic washing machine incorporated with a washing course for dry-marked clothes according to the present invention will be described in detail with reference to FIGS. 4 and 5.

Figure 1:
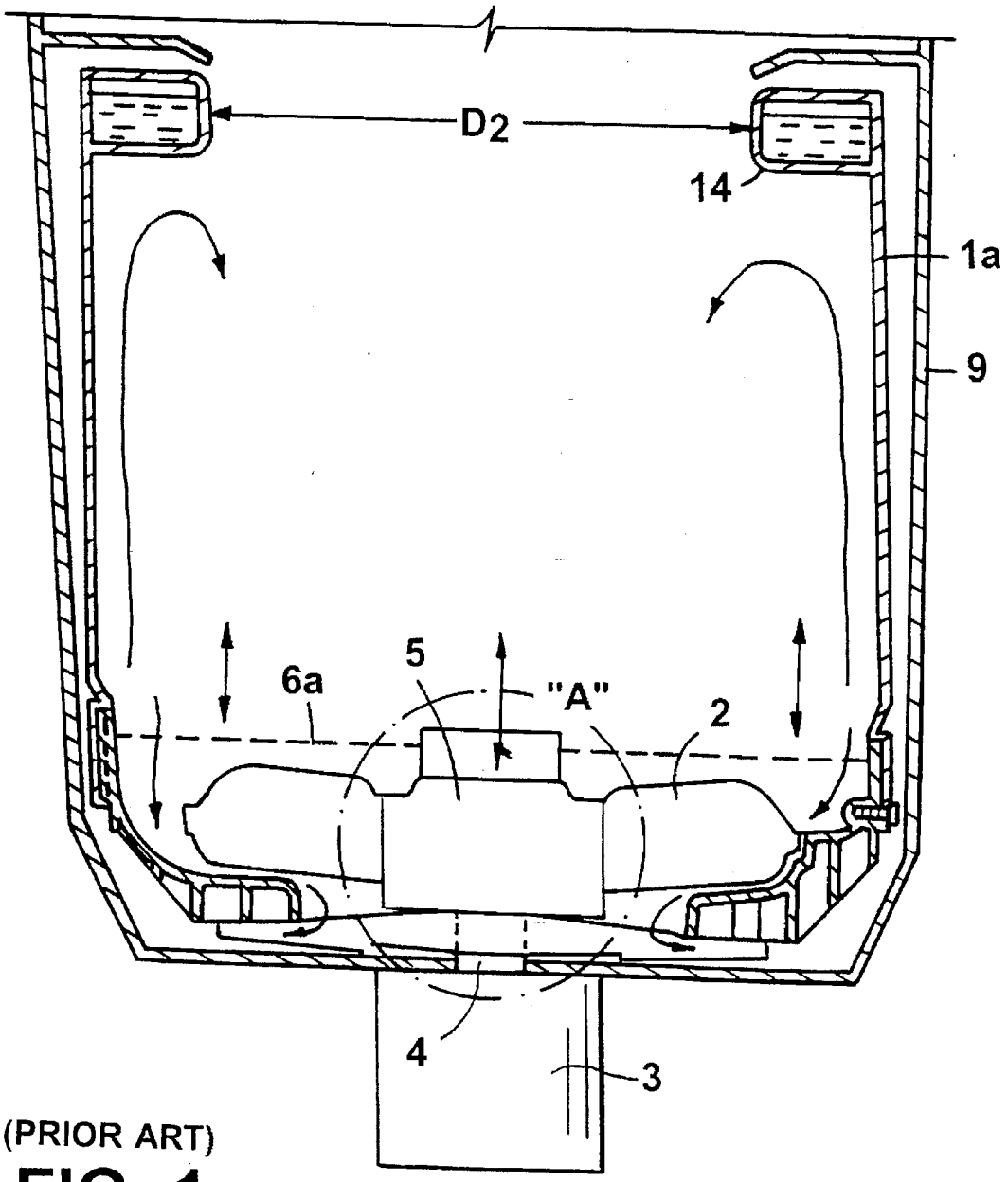
(PRIOR ART) FIG. 1
FIG. 1 is a vertical section view showing a conventional fully automatic washing machine incorporated with a washing course for dry-marked clothes.
Figure 2A:
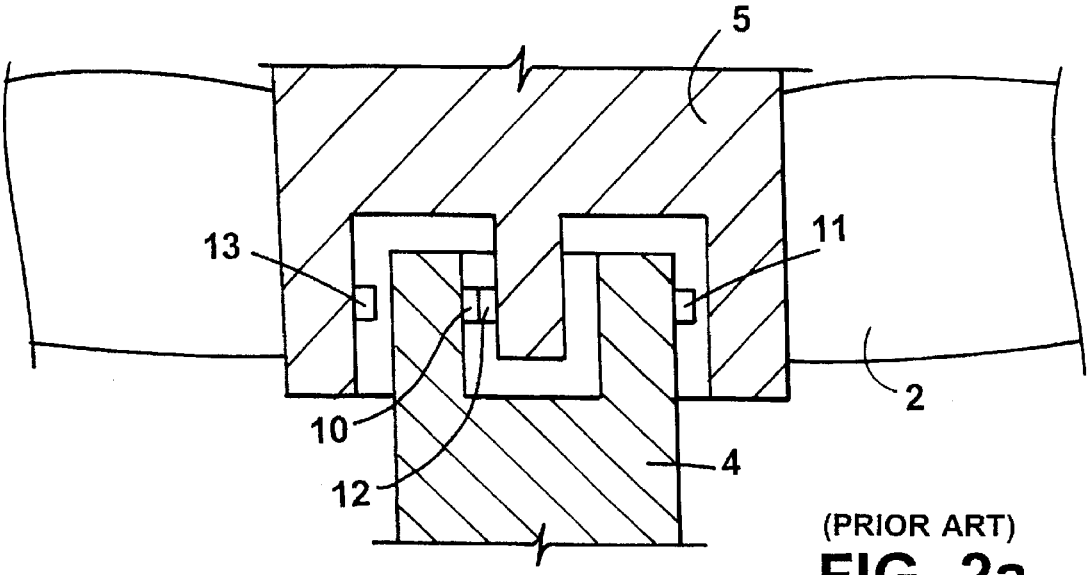
(PRIOR ART) FIG. 2a
FIGS. 2A and 2B are a vertical section view and a horizontal section view showing a portion A of FIG. 1, respectively.
Figure 2B:
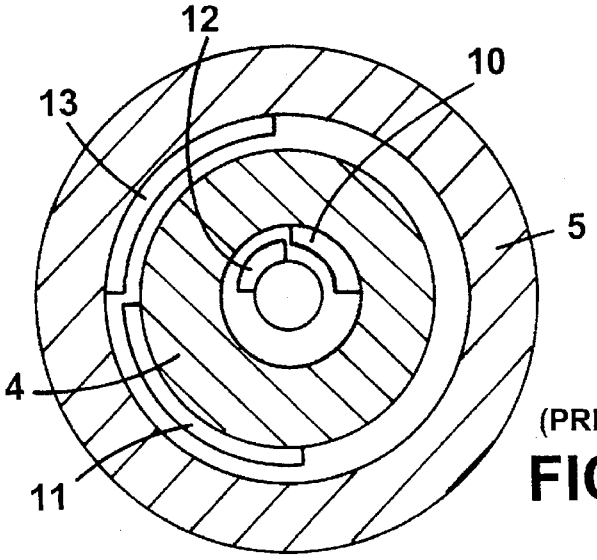
(PRIOR ART) FIG. 2b
Figure 3:
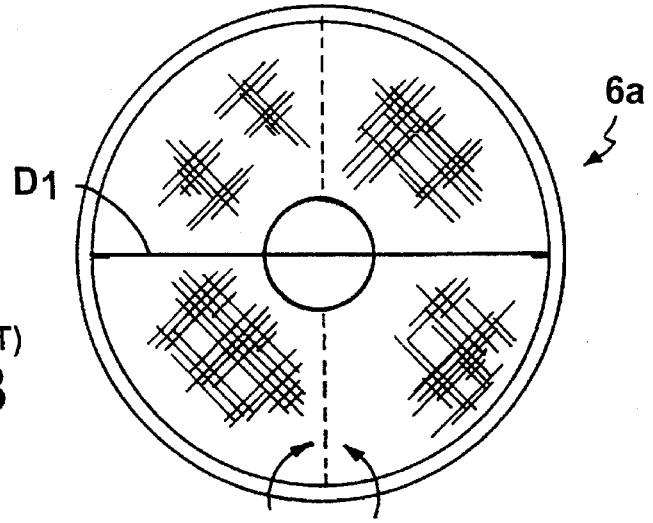
(PRIOR ART) FIG. 3
FIG. 3 is a plan view showing the washing net of FIG. 1.
Figure 4:
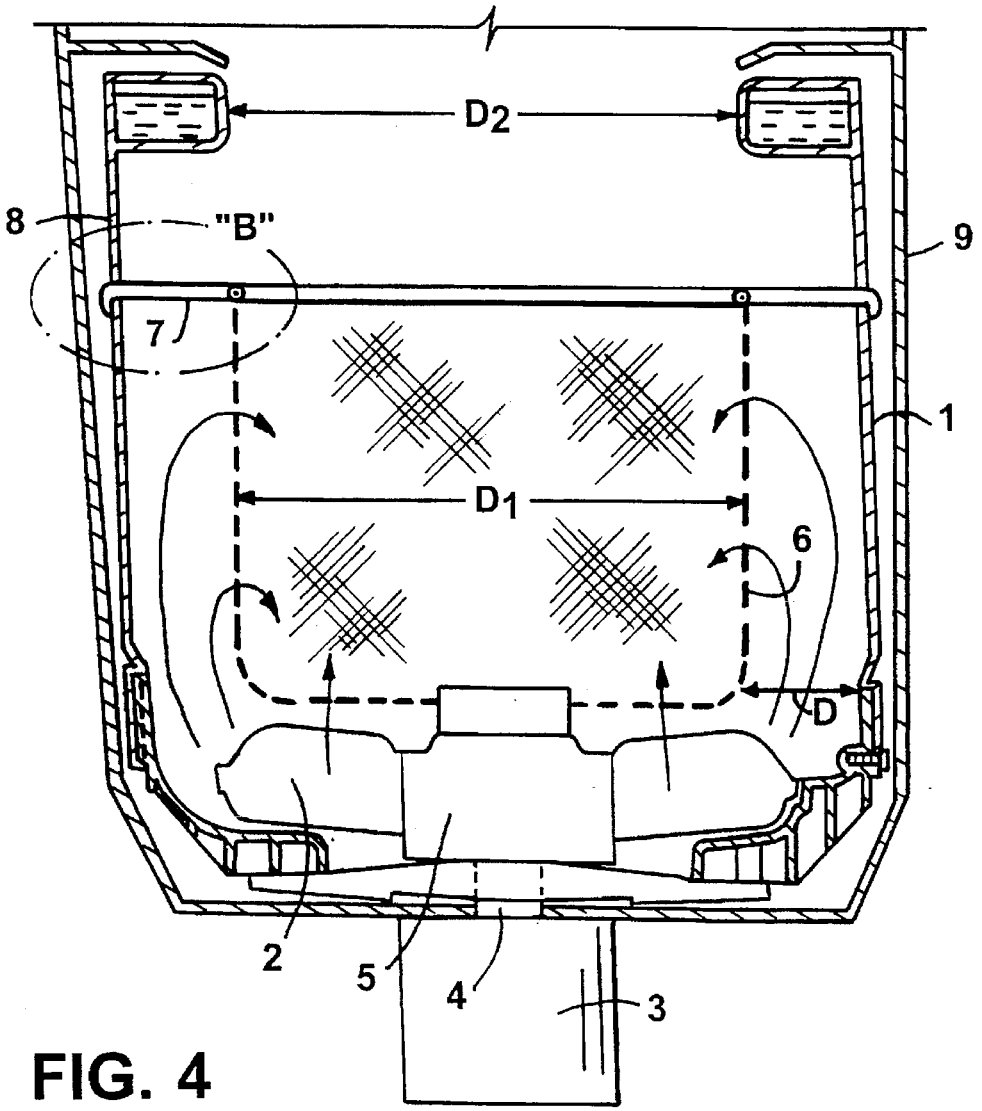
FIG. 4 is a vertical section view showing the washing machine according to the present invention.
Figure 5:
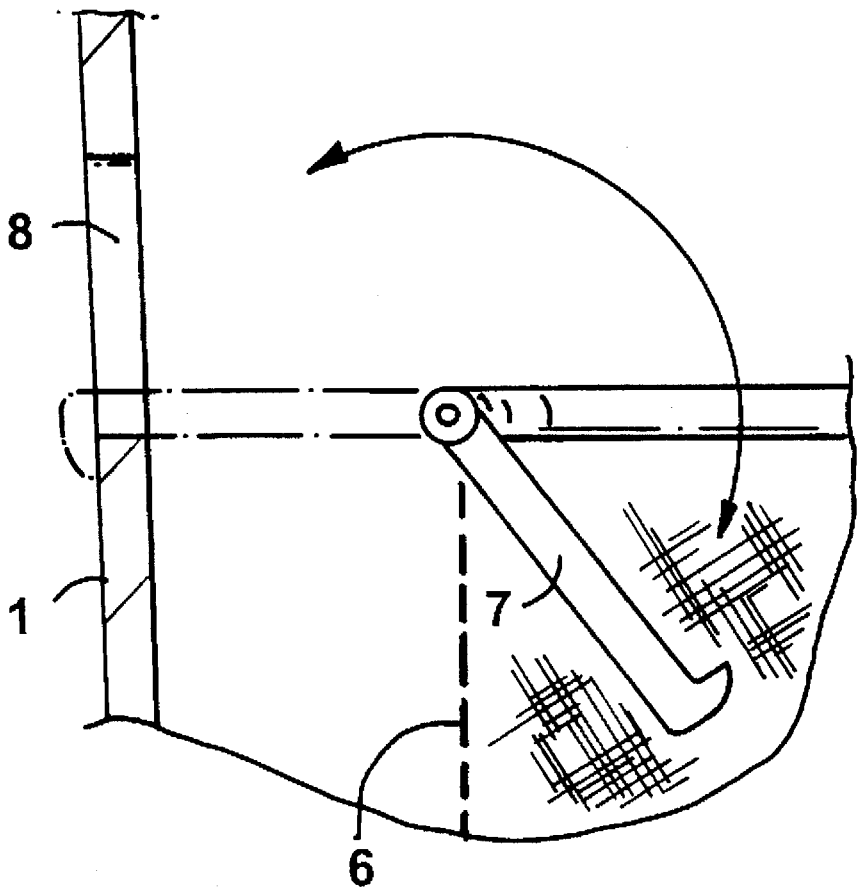
FIG. 5 is an enlargement view showing a portion B of FIG. 4.

FIG. 4 is a vertical section view showing the washing machine according to the present invention, and FIG. 5 is an enlargement view showing a portion B of FIG. 4. Here, a central lower end of a basket-type washing net 6 which is vibrated in up and down directions in accordance with a reciprocal ascending and descending movement of a driving member 5 for preserving and cleaning the laundry indicated by a dry mark is inserted to driving member 5 which is installed on a center of a washing blade 2 within a washtub 1.

A diameter $D_1$ of washing net 6 is formed to be smaller than a diameter $D_2$ of an inner circumference of the upper end of washtub 1. A plurality of fixing hooks 7 for fixing washing net 6 are rotatably installed to the upper end of washing net 6 to washtub 1 for preserving the laundry so that is not damaged by the rotation of washing net 6 which is rotated together with washing blade 2 toward the tangent line direction of washtub 1. A vertically and horizontally elongated slot 8 is formed in the upper portion of washtub 1 for allowing washing net 6 to move an amount greater than the amplitude of driving member 5 while fixing hook 7 is fixed during mounting of the washing net 6 to the inside of washtub 1.

As shown in FIGS. 4 and 5, when the dry-marked clothes are washed in the fully automatic washing machine according to the present invention constructed as above, the central bottom end of basket-type washing net 6 is inserted to driving member 5 installed to the center of washing blade 2 of washtub 1, which reciprocally ascends and descends together with the rotational movement of motor shaft 4 in accordance with the driving of motor 3.

Thereafter, a plurality of fixing hooks 7 rotatably installed to the upper end of washing net 6 are inserted to slots 8 formed in the upper portion of washtub 1 to install washing net 6 to the inside of washtub 1. By this construction, when the laundry is put in washing net 6 to begin the washing operation, washing net 6 is vibrated in the up and down directions in accordance with the reciprocal ascending and descending movement of driving member 7. Consequently, the laundry indicated with the dry mark is preserved and beaten while preventing the damage caused by the clothes being bitten into the lower portion of washing net 6, thereby efficiently cleaning the dry-marked clothes.

After the washing of the dry-marked clothes is completed, in the reverse order of installing washing net 6, fixing hooks 7 rotatably installed to the upper end of washing net 6 are extracted out of slots 8 in washtub 1. Then, washing net 6 inserted to the center of driving member 7 is removed from the driving member 7.

The, plurality of fixing hooks 7 rotatably installed to the upper end of washing net 6 can fix washing net 6 for preventing damage to the laundry due to the rotation of washing net 6 together with washing blade 2 toward the tangent line of washtub 1. Slot 8 vertically and horizontally elongated in the upper portion of washtub 1 fixes fixing hook 7 when washing net 6 is mounted to the inside of washtub 1, and at the same time, forces washing net 6 to move greater than the amplitude of driving member 5, thereby enhancing the washing efficiency.

In addition, a distance D is provided between basket-type washing net 6 and washtub 1 to realize the efficient washing by a waterstream passing through the mesh of washing net 6 and a constantly flowing waterstream. Furthermore, diameter $D_1$ of washing net 6 is formed to be smaller than diameter $D_2$ of the inner circumference of the upper end of washtub 1, so that a user easily attaches and detaches basket-type washing net 6 to and from washtub 1.

As a result, when the dry-marked clothes are washed in the fully automatic washing machine described as above, basket-type washing net 6 having a diameter smaller than the inner diameter of the upper end of washtub 1 is employed to easily attach and detach washing net 6 by means of the simple structure, thereby providing a convenience to the user. Moreover, the laundry is prevented from being damaged by the clothes being bitten in the lower portion of washing net 6 to significantly enhance the efficiency and reliability of the product.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A washing structure of a fully automatic washing machine, the washing structure comprising:

a washtub, a driving member configured to vibrate the clothes within the wash tub using a reciprocal ascending and descending movement, a basket-shaped washing net configured to be attached or detached within the washtub for being vibrated in up and down directions in accordance with the reciprocal ascending and descending movement of the driving member, and a plurality of rotating attachment hooks connected to an upper end of said washing net for attaching said washing net within said washtub to prevent damage to said laundry caused by the rotation of said washing net toward a tangent line of said washtub, wherein slots are formed in an upper portion of said washtub for attaching said attachment hooks when said washing net is mounted within said washtub.

2. A washing structure of a fully automatic washing machine as claimed in claim 1, wherein a diameter of said washing net is formed to be smaller than a diameter of an inner circumference of an upper end of said washtub to facilitate the attachment and detachment of said washing net.

3. A washing structure of a fully automatic washing machine as claimed in claim 1, wherein each said slot is vertically and horizontally elongated to allow said washing net to move greater than the amplitude of said driving member.

* * * * *